United States Patent [19]

Mitchell

[11] 4,339,934

[45] Jul. 20, 1982

[54] STRIP SHAPE CONTROL

[75] Inventor: Randolph N. Mitchell, Rome, Italy

[73] Assignee: Reynolds Metals Company, Richmond, Va.

[21] Appl. No.: 211,301

[22] Filed: Nov. 28, 1980

[51] Int. Cl.[3] ..... B21B 37/04

[52] U.S. Cl. ..... 72/17; 72/250

[58] Field of Search ..... 72/17, 21, 250, 183; 242/75.2

[56] References Cited

U.S. PATENT DOCUMENTS 3,078,747 2/1963 Pearson ..... 80/56
3,499,306 3/1970 Pearson ..... 72/17
3,820,367 6/1974 Kline ..... 72/17
4,232,540 11/1980 Cain et al. ..... 72/17
4,262,511 4/1981 Boisnert ..... 72/17

OTHER PUBLICATIONS

U.S. application Ser. No. 940,651.

*Primary Examiner*—Leon Gilden
*Attorney, Agent, or Firm*—Lyne, Girard & McDonald

[57] ABSTRACT

In a metal strip rolling mill having a strip shape measuring means connected to adjust the mill to control the strip shape, improved strip shape control performance is achieved by mounting a hold-down roll between the measuring means and the take-up reel.

5 Claims, 1 Drawing Figure

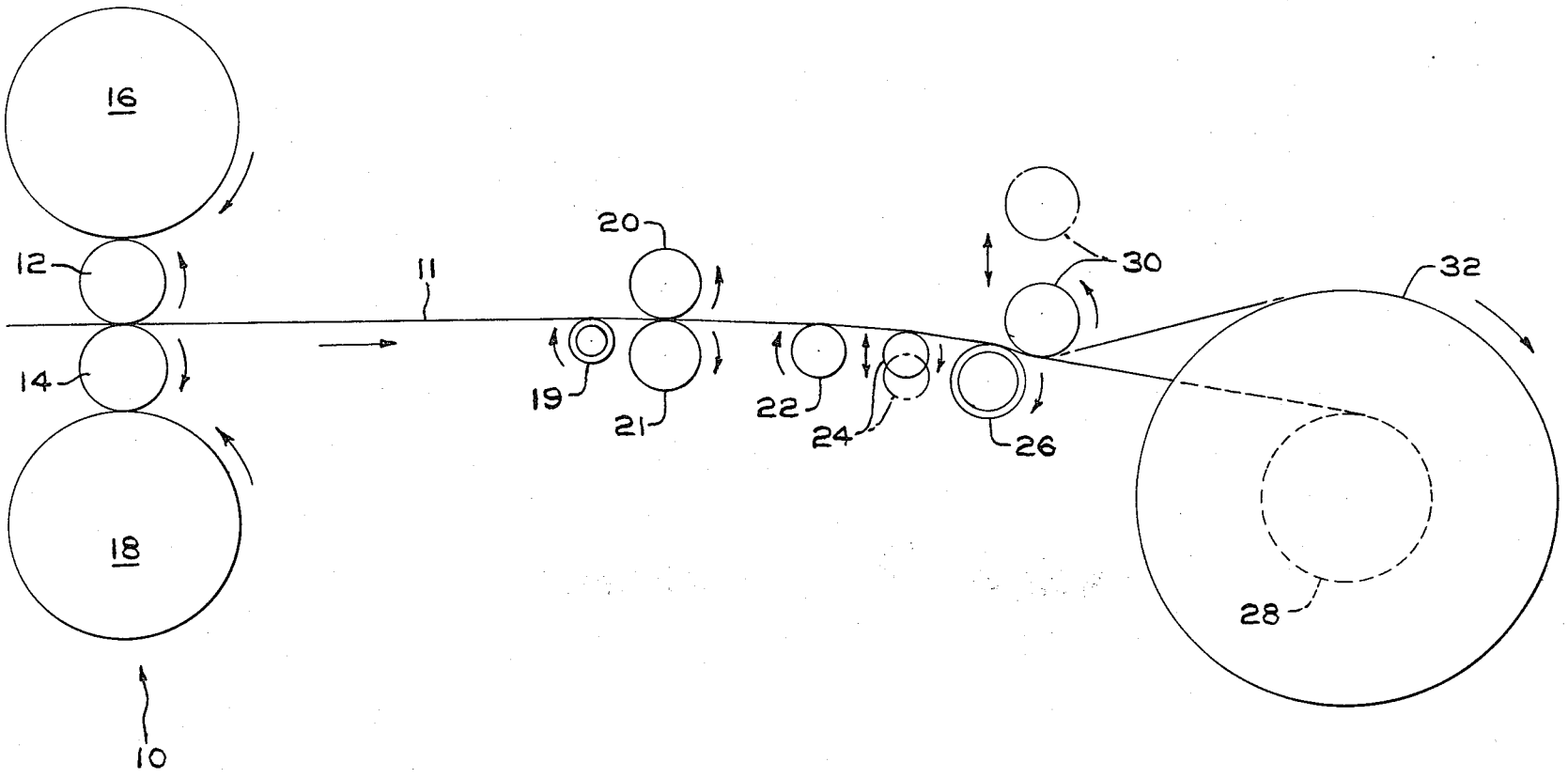
32
28
30
26
24
22
20
21
19
11
16
18
12
14
10

STRIP SHAPE CONTROL

BACKGROUND OF THE INVENTION

The concept of sensing the shape of metal strip emerging from a rolling mill and adjusting the mill in response to signals from the sensor, for improved strip shape control, is disclosed, for example, in Pearson U.S. Pat. Nos. 3,078,747 and 3,499,306. Such units have been proven effective in various commercial installations. However, there is some degree of undesired variation in strip shape even with the use of such controls, and efforts continue to be made to reduce the amount of this variation.

SUMMARY OF THE INVENTION

In accordance with the present invention, a hold-down roll is mounted between the strip gauge sensing unit which controls the mill and the take-up reel which coils the strip under tension. The hold-down roll is held against the strip with a controlled degree of pressure.

It is ordinarily the case that strip is rolled with a slightly greater gauge in the center than along the sides of this strip, and as the strip is coiled on the take-up reel in successive wraps the thicker portions of the strip in the middle tend to give a crown effect at the center of the coiled strip. This crown effect, in conjunction with the normal tension of the take-up reel, influences what the shape measuring unit senses, and thereby tends to distort the corrective signals from the sensing unit to the mill. In accordance with the invention, this distortion is minimized when the hold-down roll of the invention is pressed against the strip between the sensing unit and the take-up reel, under conditions where the sensing unit presses against one face of the strip and the hold-down roll presses against the opposite face of the strip.

Other details and advantages of the invention will be apparent as the following description of the presently preferred embodiment thereof shown in the accompanying drawing proceeds.

BRIEF DESCRIPTION OF THE DRAWING

The accompanying FIGURE schematically illustrates a side view of a rolling mill, take-up reel and strip shape sensing and control unit, with a hold-down roll in accordance with the invention.

DESCRIPTION OF THE PREFERRED EMBODIMENT

Referring now more particularly to the FIGURE, the illustrated rolling mill 10 has a pair of work rolls 12 and 14 between back-up rolls 16 and 18. A metal strip 11, such as an aluminum strip, is reduced in gauge as it passes between the work rolls 12 and 14. The strip 11 next passes over an idler supporting roll 19 and between a pair of edge trimming rolls 20 and 21. Next, the strip 11 passes over an idler supporting roll 22, a shape measuring roll 24 and a second idler supporting roll 26, before being taken up on a tension take-up reel 28. The shape measuring roll 24 senses the shape of the moving strip 11, and is connected, by means not shown, to the rolling mill 10, to make corrective changes in the operation of the rolling mill for purposes of attaining the desired shape of the strip 11 as it leaves the work rolls 12 and 14. This strip shape measuring roll 24 is mounted to be vertically positioned away from the strip 11, when required, to prevent damage to the shape measuring roll 24. The rolling mill 10, and rolls 19, 20, 21, 22, 24, and 26, the take-up reel 28, and the automatic corrective action of the shape measuring roll 24 are old in the art relative to the present invention.

A cylindrical hold-down roll 30 in accordance with present invention is retractably mounted and in operation is pressed down against the upper surface of the strip 11 between the supporting roll 26 and the periphery of the coil 32 being wound on take-up reel 28. The retracted position of roll 30 is shown in dashed lines. Hydraulic pressure means (not shown) are provided to maintain the roll 30 in proper position against positive adjustable stops (not shown) and against the strip 11, in all positions of the strip as the coil 32 around the take-up reel 28 grows to its maximum diameter. In this way, the uneven tension across the width of the strip 11, resulting from greater thickness of the strip in the middle than along its sides, is minimized, insofar as it may affect the sensing of the shape measuring roll 24. As a result, better strip control results are obtained.

EXAMPLE

In accordance with the invention, aluminum strips were rolled in a strip rolling system as illustrated in the FIGURE and in which vertical height measurements were taken from the center of the nip between rolls 12 and 14 and horizontal spacing measurements were taken from vertical centerlines between the rolls. The supporting roll 19 was positioned 1925 millimeters from the rolling mill 12 and its uppermost height was 50 millimeters above the nip between rolls 12 and 14. The trimming rolls 20 and 21 were positioned 325 millimeters from the supporting roll 19 and the nip between rolls 20 and 21 was positioned 52 millimeters above the nip between rolls 12 and 14.

The supporting roll 22 was positioned 620 millimeters from the trimming rolls 20 and 21 and 50 millimeters above the nip between rolls 12 and 14. This roll 22 had a diameter of 220 millimeters. The shape measuring roll 24 was positioned 370 millimeters from the supporting roll 22 and 21 millimeters above the nip between rolls 12 and 14. The shape measuring roll 24 had a diameter of 180 millimeters. The supporting roll 26 was positioned 340 millimeters from the shape measuring roll 24 and 25 millimeters below the nip between rolls 12 and 14. This supporting roll 26 had a diameter of 300 millimeters.

The hold-down roll 30 was positioned 250 millimeters from the supporting roll 26 and 50 millimeters below the nip between rolls 12 and 14. The hold-down roll 30 had a diameter of 300 millimeters and applied a force of approximately 9071.8 kilograms to the strip 11. The take-up reel 28 was positioned 1230 millimeters from the hold-down roll 30 and 710 millimeters below the nip between rolls 12 and 14. The coil 32 had an inside diameter equal to the diameter of the take-up reel 28 of 650 millimeters and a maximum outside diameter of 1950 millimeters.

The strips 11 had thicknesses ranging between 0.2 and 4.5 millimeters nominal thickness as the strips 11 left the rolling mill 10 and a width of 1500 millimeters. The flatness across the width of the strips 11 was controlled to between 5 to 10 Alcan I units. This compares to flatness control of between 10 to 20 Alcan I units in the best comparable mills not employing the hold-down roll of the invention.

While a presently preferred embodiment of the invention and method of practicing the same has been illustrated and described, it will be understood that the invention may be otherwise embodied and practiced within the scope of the following claims.

What is claimed is:

1. In a metallic strip rolling apparatus comprising a rolling mill, a tension take-up reel to receive strip rolled through said mill and strip shape sensing means mounted between said mill and said take-up reel and constructed and arranged to adjust said mill for automatic correction of the shape of said strip being rolled in said mill, the improvement comprising a roll mounted to press against said strip between said shape sensing means and said take-up reel, said shape sensing means and said roll being in contact with opposite faces of said strip, and means responsive to the amount of said strip on said take-up reel for controlling the vertical position of said roll relative to said shape sensing means.

2. Apparatus according to claim 1 in which said shape sensing means is positioned beneath said strip and said roll is positioned above the strip.

3. Apparatus according to claim 1 in which said shape sensing means rolls against said strip.

4. In a method of controlling the shape of a metallic strip as its thickness is reduced in a rolling mill wherein the shape of said strip is sensed at a sensing position by contact with said strip as said strip passes to a take-up reel, the improvement comprising contacting a roll against said strip between said sensing position and said take-up reel, said sensing contact and said roll contact being on opposite faces of said strip, and responding to the amount of said strip on said take-up reel by controlling the vertical position of said roll relative to said sensing position.

5. The method of claim 4 wherein said strip is aluminum.

* * * * *